US008025742B2

(12) United States Patent
Rosenbauer et al.

(10) Patent No.: US 8,025,742 B2
(45) Date of Patent: Sep. 27, 2011

(54) DISHWASHER WITH CONTROLLER DEVICE

(75) Inventors: Michael Rosenbauer, Reimlingen (DE); Bernd Schessl, Dillingen/Donau (DE)

(73) Assignee: BSH Bosch und Siemens Hausgeraete GmbH, Munich (DE)

( * ) Notice: Subject to any disclaimer, the term of this patent is extended or adjusted under 35 U.S.C. 154(b) by 825 days.

(21) Appl. No.: 10/583,949

(22) PCT Filed: Dec. 10, 2004

(86) PCT No.: PCT/EP2004/053403

§ 371 (c)(1),
(2), (4) Date: Mar. 29, 2007

(87) PCT Pub. No.: WO2005/060814

PCT Pub. Date: Jul. 7, 2005

(65) Prior Publication Data

US 2007/0256738 A1 Nov. 8, 2007

(30) Foreign Application Priority Data

Dec. 22, 2003 (DE) ..... 103 60 556
Apr. 21, 2004 (DE) ..... 10 2004 019 342

(51) Int. Cl.
*B08B 3/00* (2006.01)

(52) U.S. Cl. ..... 134/56 D

(58) Field of Classification Search ..... 134/56 D
See application file for complete search history.

(56) References Cited

U.S. PATENT DOCUMENTS 2,660,824 A * 12/1953 Neugass ..... 40/546
2,791,050 A * 5/1957 Neugass ..... 40/544
5,995,877 A 11/1999 Brueggemann et al.
2001/0016886 A1* 8/2001 Kavanaugh et al. ..... 710/73
2003/0205954 A1* 11/2003 Oyler et al. ..... 312/311
2004/0109096 A1* 6/2004 Anderson et al. ..... 348/832

FOREIGN PATENT DOCUMENTS

DE 27 23 325 12/1978
DE 295 19 714 2/1996

(Continued)

OTHER PUBLICATIONS

Page from www.dictionary.com for the definition of matt.* International Search Report PCT/EP2004/053403.

*Primary Examiner* — Michael Kornakov
*Assistant Examiner* — Samuel Waldbaum
(74) *Attorney, Agent, or Firm* — James E. Howard; Andre Pallapies

(57) ABSTRACT

A dishwasher is provided having a controller for switching on or off, or for selection of operational functions for the dishwasher, the controller thus providing improved ease of operation and being relatively unaffected by wear and contamination. The controller has at least one touch-sensitive surface with switching functions allocated to at least one operating function, whereby the switching functions of the touch-sensitive surface may be operated with a light contact and the relevant operating function is then switched on or off, or selected. The touch-sensitive surface of the controller preferably reacts to the change in the electromagnetic field, resulting from a touching of the touch-sensitive surface, whereupon the relevant operating function is switched on or off, or selected. Improved ease of use may be achieved, whereby only a slight effort is required for selection, or to switch on a particular rinsing program, or operating function on the controller.

2 Claims, 3 Drawing Sheets

FOREIGN PATENT DOCUMENTS

| | | |
|---|---|---|
| DE | 198 32 757 | 6/1999 |
| DE | 202 11 561 | 10/2002 |
| DE | 102 03 614 | 7/2003 |
| EP | 1 273 851 | 1/2003 |
| FR | 2 767 432 | 2/1999 |
| GB | 2 022 872 | 12/1979 |

* cited by examiner

DISHWASHER WITH CONTROLLER DEVICE

The present invention relates to a dishwasher with a controller which is distinguished by ease of operation and is unaffected by contamination. The invention further relates to a controller with a display function for visible reproduction of information on the inputs made by the controller and of the operating state of the dishwasher.

Dishwashers are usually operated using rotary selector switches or buttons, where buttons are known in different designs such as, for example, short-stroke buttons or mechanical switches. Dishwashers with display devices are also known, these being used to visibly reproduce information, such as the selected rinsing program, the current status of the rinsing program or the filling level of rinsing agents, clear-rinsing agents or other agents required for operation of the dishwasher. In the known dishwashers the display devices are separate from the control elements and usually comprise a plurality of displays each provided for reproducing certain information, such as, for example, the operation of the dishwasher.

The known controller devices have the disadvantage that they comprise moving parts which are liable to wear and whose functioning can also be impaired by contamination. The display devices according to the prior art have the disadvantage that a plurality of display areas are required to display a plurality of information and that different lamps must be used to reproduce different colours.

It is thus the object of the present invention to eliminate the aforesaid disadvantages and provide a dishwasher with a controller with improved ease of operation and being relatively unaffected by wear and contamination.

This object is achieved by the dishwasher according to the invention having the features according to claim 1. Advantageous further developments of the present invention are characterised in the dependent claims 2 to 10.

BRIEF DESCRIPTION OF THE DRAWINGS

FIGS. 1-3 illustrates an exemplary embodiment of a dishwasher 10 in accordance with the present invention. The dishwasher 10 includes a door 12 which is openable to reveal a washing container 16. FIG. 3 illustrates a controller 14 having a touch-sensitive surface which has a flat surface that is flush with the top surface of the end of the door 12 in which the controller 14.

Figure 1:
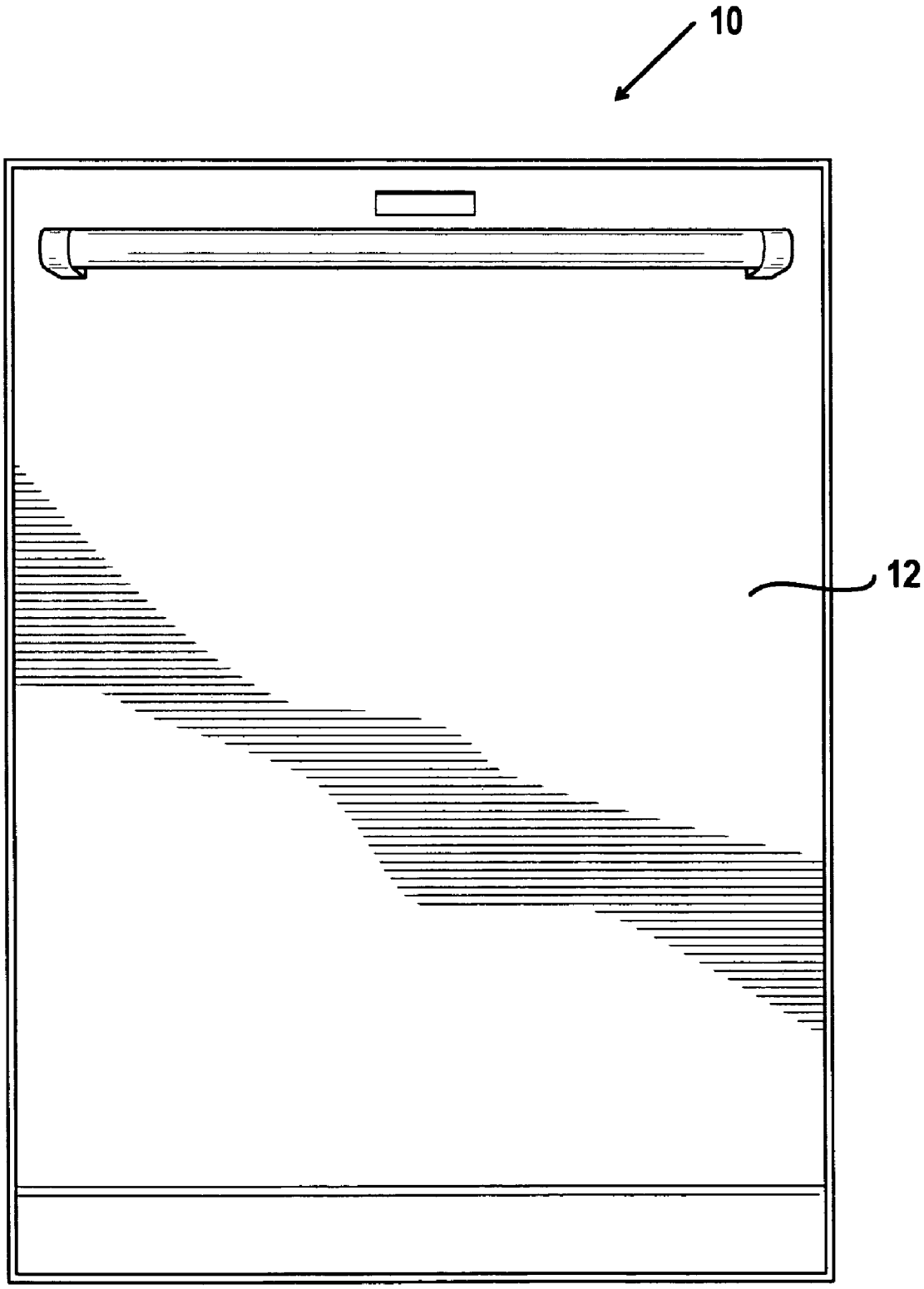
FIG. 1 is a front elevation view of an exemplary embodiment of a dishwasher 10 in accordance the present invention.
Figure 2:
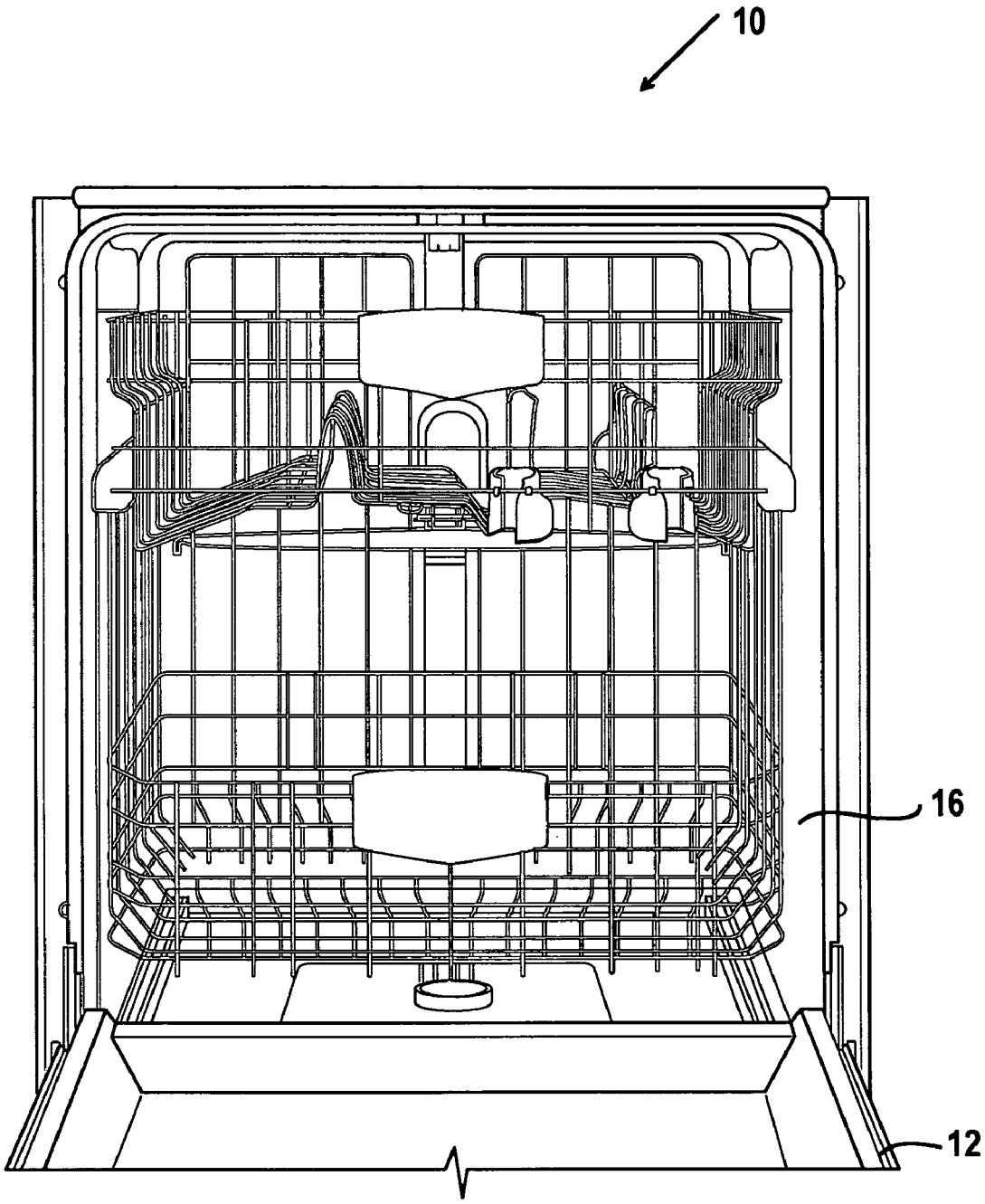
FIG. 2 is a front elevation view of the embodiment of the dishwasher 10 of FIG. 1 with the door 12 open to reveal a washing container 16.
Figure 3:
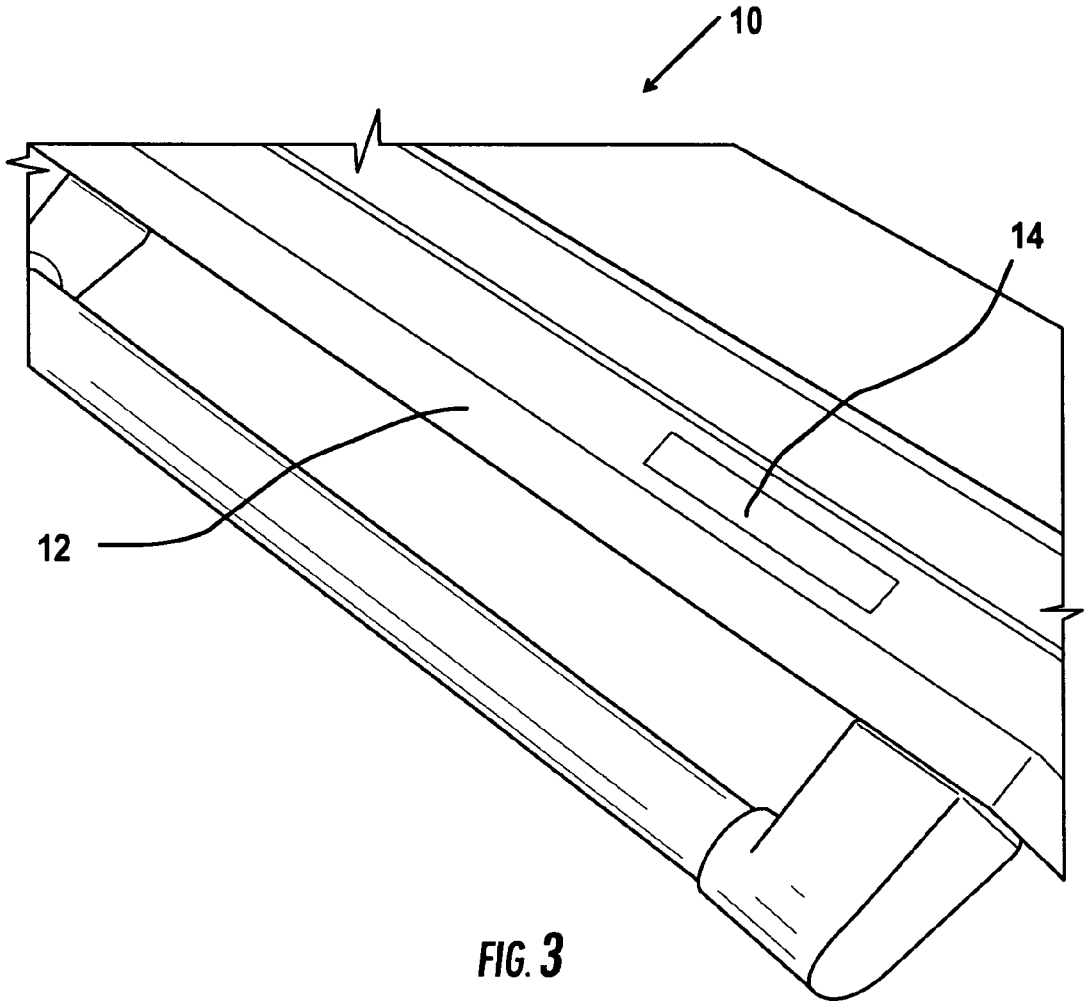
FIG. 3 is a partial overhead perspective view of a controller 14 on the door 12 of the dishwasher 10.

In the dishwasher according to the invention, a controller is provided comprising a control device for switching on or off, or for selection of operational functions of, the dishwasher, comprising at least one touch-sensitive surface with switching functions allocated to at least one operating function, wherein the switching function of the touch-sensitive surface may be actuated by light contact and the relevant operating function is thereby switched on or off, or selected. In this case, the touch-sensitive surface of the controller preferably reacts to the change in the electromagnetic field, e.g. capacitively by means of a capacitor or by means of an infrared light barrier or a piezo-element as a result of a contact and the relevant operating function is then switched on or off or selected. For this purpose, the touch-sensitive surface is connected to suitable electronic circuits, such as a flip-flop circuit for example, which respond to a change in the electromagnetic field caused by touching the touch-sensitive surface, thereby changing their switching status. Furthermore, the operating function can also be switched on or off capacitively at the touch-sensitive surface, e.g. using a capacitor or a piezo-element.

The principle forming the basis of the present invention is consequently to fit the controller with touch-sensitive surfaces having a switching function which change their switching state as a result of a slight touch by an operator. In this way, no effort or very little effort is required from the operator to select or switch on, for example, a specific rinsing program or operating functions on the controller, which improves ease of operation.

In a preferred embodiment of the present invention, the controller comprises a number of touch-sensitive surfaces with switching functions, each being allocated at least one operating function. Such operating functions of the dishwasher are, for example, selecting a washing program to be carried out, entering a desired operating temperature or requesting the current operating state, the (remaining) run time of the washing program or the filling level of rinsing agents or clear rinsing agents.

It is especially advantageous if the touch-sensitive surface of the controller has a flat surface which is disposed substantially in the same plane as the surface in which the controller is located on the dishwasher and preferably ends flush with the surface surrounding it. As a result of the small overall depth of the controller, this can be arranged for the most part in a discretionary manner at easily accessible locations on the dishwasher, such as on the panel in the upper area or the upper edge of a hinged door of the dishwasher. The flush termination of the controller with the surface in which the controller is integrated has the advantageous effect that the controller is not susceptible to contamination since there are no projecting parts at which dirt could be trapped. Since the controller merely has touch-sensitive surfaces which have no moving parts, a mechanically induced fault is also eliminated.

The touch-sensitive surfaces of the controller can be covered at least partly by a transparent film, for example, made of plastic. As a result of the transparency of the covering film, any lettering on the touch-sensitive surfaces under the covering film can be identified. Covering the controller by means of a transparent film further has the advantage that the controller is protected from direct contamination and any contamination on the transparent film can easily be removed.

The covering of the touch-sensitive surface of the controller can consist at least in part of a metal film which is sufficiently flexible to transfer the pressure exerted on the metal film to the relevant touch-sensitive surface of the controller. Appropriately, the metal film is provided with obvious lettering to identify the operating function of the touch-sensitive surface of the controller located thereunder.

It is a further object of the present invention to provide a dishwasher with a display device that displays the inputs or settings made on the controller. This object is achieved by a preferred embodiment of the present invention wherein the touch-sensitive surfaces of the controller are controllably illuminated by one or more lamps. The backlighting of the controller can be configured so that the controller is uniformly illuminated. This ensures that the operating functions of the individual touch-sensitive surfaces of the controller can be identified even under unfavorable light conditions. Appropriately, for this purpose the viewing area of the controller is made at least partly of transparent, preferably matt-finished material since the backlighting and the reproduction of the lettering applied to the touch-sensitive surfaces is particularly effective through such material. Alternatively, the backlighting of the contact surfaces of the controller can be regulated such that the contact surface only lights up when the relevant operating function is switched on or selected. The selection or activation of the relevant operating functions is thereby displayed directly.

In addition, it is advantageous if the luminous intensity of the individual lamps can be regulated in steps. In this way, for example, a touch-sensitive surface of the controller can be only weakly backlit if the relevant operating function was not selected or switched on and can be more brightly backlit if the operating function has been selected or switched on. In this case, it is possible to display different stages of an operating function by backlighting the relevant touch-sensitive surface at different intensity. Light-emitting diodes are particularly suitable as lamps since they have a low power consumption on the one hand and are not very liable to break down on the other hand.

In addition or alternatively, the backlighting can be configured so that each touch-sensitive surface of the controller is backlit by a separate lamp, at least one lamp being provided for backlighting of each individual touch-sensitive surface. This makes it possible to display the selection or activation of the relevant operating function of the touch-sensitive surface by backlighting a specific touch-sensitive surface. A further advantage of the individual backlighting of the touch-sensitive surfaces by separate lamps is that the selection or activation of the relevant operating function is indicated directly by illuminating the relevant touch-sensitive surface, i.e. the touch-sensitive surface and display surface are identical. The controller according to the invention in this way also becomes a display device that displays information on the inputs made by the controller and the operating state of the dishwasher to the user.

In a further embodiment of the present invention, the touch-sensitive surfaces of the controller are backlit by lamps of different light colour. By this means, for example, a failed operating function or an anomalous operating state of the dishwasher could be identified by red backlighting for example, whereas problem-free functioning can be indicated by green backlighting. In order to give the backlit controller a uniform impression of colour, the transparent film covering the controller can be appropriately coloured.

The invention claimed is:

1. A dishwasher, comprising:

a container for retaining items to be subjected to a dishwasher operation; and a controller for one of the controlling an operating function effecting a switching on of the dishwasher, controlling an operating function effecting a switching off of the dishwasher, and selecting operational functions of the dishwasher, the controller including a touch-sensitive surface with switching functions allocated to an operating function, wherein the switching function of the touch-sensitive is actuable by relatively light touching contact and the relevant operating function is thereby respectively switched off, switched on, or selected; and wherein the touch-sensitive surface of the controller is controllable illuminated by a lamp;

and wherein the touch-sensitive surface is controllably illuminated in steps.

2. A dishwasher comprising:

a controller that controls the operation of the dishwasher; and a touch-sensitive user interface in communication with the controller that is responsive to a change in an electromagnetic field; and wherein the user interface is controllably illuminated in steps.

* * * * *